US009520633B2

(12) United States Patent
Helszajn et al.

(10) Patent No.: US 9,520,633 B2
(45) Date of Patent: Dec. 13, 2016

(54) WAVEGUIDE CIRCULATOR CONFIGURATION AND METHOD OF USING SAME

(71) Applicant: APOLLO MICROWAVES, LTD., Dorval (CA)

(72) Inventors: Joseph Helszajn, Edinburgh (GB); Louis-Philippe Carignan, Pincourt (CA); Marco Caplin, Kirkland (CA)

(73) Assignee: Apollo Microwaves LTD., Quebec (CA)

( * ) Notice: Subject to any disclaimer, the term of this patent is extended or adjusted under 35 U.S.C. 154(b) by 162 days.

(21) Appl. No.: 14/223,628

(22) Filed: Mar. 24, 2014

(65) Prior Publication Data

US 2015/0270594 A1 Sep. 24, 2015

(51) Int. Cl.
*H01P 1/39* (2006.01)

(52) U.S. Cl.
CPC ..... *H01P 1/39* (2013.01); *Y10T 29/49016* (2015.01)

(58) Field of Classification Search
CPC ..... H01P 1/39
USPC ..... 333/1.1, 24.2
See application file for complete search history.

(56) References Cited

U.S. PATENT DOCUMENTS

| | | | |
|---|---|---|---|
| 3,295,074 | A | 12/1966 | Carr |
| 3,350,663 | A | 10/1967 | Siekanowicz et al. |
| 3,466,571 | A | 9/1969 | Jansen et al. |
| 3,593,210 | A | 7/1971 | Skedd et al. |
| 3,673,518 | A | 6/1972 | Carr |
| 3,866,150 | A | 2/1975 | Thai et al. |
| 3,928,824 | A | 12/1975 | Takahashi et al. |
| 4,058,780 | A | 11/1977 | Riblet |
| 4,638,267 | A | 1/1987 | Holpp |
| 4,672,333 | A | 6/1987 | Bartels |
| 4,684,908 | A | 8/1987 | Kuntzmann et al. |

(Continued)

FOREIGN PATENT DOCUMENTS

| | | |
|---|---|---|
| EP | 2698863 | 2/2014 |
| EP | 2698864 | 2/2014 |

(Continued)

OTHER PUBLICATIONS

J. Helszajn et al., "WR75 junction circulator using 90 degree and 180 degree ridge UEs", IEE Proc.-Microw. Antennas Propag., vol. 149, No. 2, Apr. 2002, pp. 129-137.

(Continued)

*Primary Examiner* — Stephen E Jones
(74) *Attorney, Agent, or Firm* — Sheridan Ross P.C.

(57) ABSTRACT

A waveguide circulator comprising at least three waveguide arms intersecting at a junction, wherein the junction has an upper inner surface and a lower inner surface; and a ferrite element positioned within a recess formed within one of the upper inner surface and the lower inner surface of the junction, the ferrite element including a first portion that projects into the junction and a second portion that extends into the recess. A projection extends from an upper outer surface of the junction opposite the upper inner surface of the junction, the projection being positioned opposite the recess formed on the upper inner surface of the junction. In use, the ferrite element is magnetized by applying a magnetic field thereto using a magnet or electromagnet shaped for matingly engaging the projection. A method for manufacturing a waveguide circulator of the type described above is also provided.

10 Claims, 9 Drawing Sheets

(56) References Cited

U.S. PATENT DOCUMENTS

| | | | | |
|---|---|---|---|---|
| 4,697,158 | A | 9/1987 | Hoover et al. | |
| 4,808,949 | A | 2/1989 | Forterre | |
| 5,576,670 | A | 11/1996 | Suzuki et al. | |
| 6,359,792 | B1 | 3/2002 | Genfan | |
| 6,407,646 | B1 | 6/2002 | Johnson | |
| 6,518,851 | B2 | 2/2003 | Kocharyan | |
| 6,885,257 | B2 | 4/2005 | Kroening | |
| 7,019,706 | B2 | 3/2006 | Yoneda et al. | |
| 7,176,767 | B2 | 2/2007 | Kroening | |
| 7,230,507 | B2 | 6/2007 | Kroening | |
| 7,242,263 | B2 | 7/2007 | Kroening | |
| 7,259,640 | B2 | 8/2007 | Brown et al. | |
| 7,332,982 | B2 | 2/2008 | Yun et al. | |
| 7,683,731 | B2 | 3/2010 | Kroening | |
| 7,746,189 | B2 | 6/2010 | Hocine et al. | |
| 8,803,628 | B1 | 8/2014 | Kroening | |
| 8,878,623 | B2 | 11/2014 | Kroening | |
| 8,941,446 | B2 | 1/2015 | Kroening | |
| 8,957,741 | B2 | 2/2015 | Kroening | |
| 9,263,783 | B2 * | 2/2016 | Kroening | H01P 1/38 |
| 2005/0184833 | A1 | 8/2005 | Higgins et al. | |
| 2006/0232353 | A1 | 10/2006 | Kroeing | |
| 2006/0261909 | A1 | 11/2006 | Kroening | |
| 2010/0207701 | A1 * | 8/2010 | Ikoma | H01P 1/39 333/1.1 |
| 2013/0321090 | A1 | 12/2013 | Cruickshank et al. | |
| 2014/0320227 | A1 | 10/2014 | Kroening et al. | |

FOREIGN PATENT DOCUMENTS

| | | | |
|---|---|---|---|
| EP | 2698866 | | 2/2014 |
| EP | 2830150 | | 1/2015 |
| JP | S61125202 | A | 6/1986 |
| JP | 2007005955 | A | 1/2007 |
| WO | 88/06807 | A1 | 9/1988 |

OTHER PUBLICATIONS

H. Yoshinaga et al., "Design and fabrication of a nonradiative dielectric waveguidecirculator", http://ieeexplore.ieee.org/xpl/absprintf.jsp?arnumber=8917&page=FREE, Microwave Theory and Techniques, IEEE Transactions, vol. 36, Issue 11, Nov. 1988, pp. 1526-1529.

J. Helszajn et al., "Cut-off space of a gyromagnetic planar disk resonator with a triplet of stubs with up and down magnetisation", www.ietdl.org, IET Microwaves, Antennas & Propagation, vol. 6, Iss. 5, Feb. 3, 2012, pp. 569-576.

J. Helszajn et al., "Semi-experimental characterisation of the 3-port waveguide junction circulator containing a gyromagnetic post resonator", www.ietdl.org, IET Microwaves, Antennas & Propagation, vol. 6, Iss. 3, Nov. 11, 2011, pp. 331-337.

Herman N. Chait et al., "Y Circulator", Journal of Applied Physics, Supplement to vol. 30, No. 4, Apr. 1959, pp. 152S-153S.

W. W. Siekanowicz et al., "New Type of Latching Switchable Ferrite Junction Circulator", IEEE Transactions on Microwave Theory and Techniques, vol. MTT-16, No. 3, Mar. 1968, pp. 177-183.

J. Helszajn et al., "Adjustment of H-Plane Waveguide Tee-Junction Circulator Using a Circular Post Gyromagnetic Resonator", International Journal of RF and Microwave Computer-Aided Engineering, vol. 24, No. 1, Jun. 17, 2013, pp. 55-58.

* cited by examiner

WAVEGUIDE CIRCULATOR CONFIGURATION AND METHOD OF USING SAME

FIELD OF THE INVENTION

The present invention relates to the field of passive waveguide components and, specifically, to a waveguide circulator having a configuration including one or more gyromagnetic ferrite elements positioned within one or more respective recesses formed on the interior surface of the waveguide circulator.

BACKGROUND

Waveguide circulators are known in the art for handling RF waves. Typically, waveguide circulators include three ports (although more or less ports are possible) and are used for transferring wave energy in a non-reciprocal manner, such that when wave energy is fed into one port, it is essentially transferred to the next port only. A common use for waveguide circulators is to transmit energy from a transmitter to an antenna during transmitting operations, and to transmit energy from an antenna to a receiver during receiving operations. In order to enable the non-reciprocal energy transfer, the waveguide circulators include ferrite elements to which are applied a magnetic field via one or more magnets or electromagnets.

An example of a typical waveguide circulator 1 is illustrated in FIGS. 1A and 1B. In this example, the waveguide circulator 1 has three waveguide arms 2, 4 and 6 that meet at a common junction 8. Shown in FIG. 1B is a side view of the waveguide circulator 1 with a view into waveguide arm 6. Positioned within the junction 8 of the waveguide circulator 1 is a pair of gyromagnetic members 5 and 7, which are also referred to as "ferrite elements" and are typically made of a ferrite material. The ferrite elements 5 and 7 are positioned within the junction 8, generally upon mounting posts 50 and 70 located on opposing inner surfaces 3 and 3' of the junction 8, such that they are centrally disposed and arranged symmetrically, with respect to the three waveguide arms 12, 14 and 16.

During operation, the ferrite elements 5 and 7 are subjected to the influence of a magnetic field that is generated by one or more magnets or electromagnets (not shown), which can be positioned on outside surfaces of the junction 8 above and below the ferrite elements 5 and 7. The magnetic field that is generated is a unidirectional magnetic field, represented by arrow 9 in FIGS. 1A and 1B, such that wave energy entering each waveguide arm 2, 4 and 6 will move in a counter-clockwise direction (or clockwise depending on the direction of the magnetic field) towards its neighboring waveguide arm. As such, the waveguide circulator 1 is a non-reciprocal transmitter of electromagnetic wave energy propagating in the waveguide arms.

A deficiency associated with many waveguide circulators of the type depicted in FIGS. 1A and 1B is that they are bulky, especially once the magnets used to magnetize the ferrite elements are positioned on the outer surfaces of the waveguide circulators.

Another deficiency associated with some waveguide circulators of the type depicted in FIGS. 1A and 1B is that they may require complex handling during manufacturing, which increases the cost of manufacturing such devices. For example, to use a circulator of the type depicted in FIGS. 1A and 1B as a switch, a current carrying wire is often placed inside the ferrites of the circulator, which significantly complicates the design and assembly of the switch.

In light of the above, there is a need in the industry for providing an improved waveguide circulator that alleviates, at least in part, the deficiencies with existing waveguide circulators.

SUMMARY

In accordance with a first aspect, the invention relates to a waveguide circulator comprising at least three waveguide arms intersecting at a junction, wherein the junction has an upper inner surface and a lower inner surface, and a ferrite element positioned within a recess formed within one of the upper inner surface and the lower inner surface of the junction, the ferrite element including a first portion that projects into the junction and a second portion that extends into the recess.

In accordance with specific practical implementations, when the recess is located within the upper inner surface of the junction, a projection extends from an upper outer surface of the junction opposite the upper inner surface of the junction, the projection being positioned opposite the recess formed on the upper inner surface of the junction. The upper outer surface of the junction defines an outer surface level and the second portion of the ferrite element extends into the recess so that at least a part of the ferrite element lies above the outer surface level defined by the upper outer surface of the junction. In such a configuration, an opposing element, which may be referred to as a "piston", may be positioned on the lower inner surface of the junction in a spaced-apart opposing relationship with the ferrite element.

In a first non-limiting embodiment, a magnet shaped to engage the projection extending from the upper outer surface of the junction may be used to magnetize the ferrite element positioned within the recess. In such cases, the waveguide circulator may comprise a magnet matingly engaged with the projection extending from the upper outer surface of the junction, the magnet being for magnetizing the ferrite element positioned within the recess.

In specific practical implementations, the projection extending from the upper outer surface of the junction may be of any suitable shape. In a non-limiting implementation in which the projection is a circular projection having a generally circular shape, the magnet may be embodied as a ring magnet shaped for matingly engaging the circular projection.

In a second non-limiting embodiment, an electromagnet including a wire loop wound at least partially around the projection extending from the upper outer surface of the junction may be used to magnetize the ferrite element positioned within the recess. In such cases, the waveguide circulator may comprise an electromagnet including a wire loop wound at least partially around the projection extending from the upper outer surface of the junction for magnetizing the ferrite element positioned within the recess.

Advantageously, when using an electromagnet to magnetize the ferrite element positioned within the recess, the waveguide circulator may be configured to act as a switch by changing the direction of the current applied to the wire loop of the electromagnet.

Another advantage of including a wire loop wound at least partially around the projection extending from the upper outer surface of the junction, rather than placing a current carrying wire inside ferrite elements in the circulator junction, is that it may simplify the handling of the circulator during manufacturing and may reduce manufacturing costs.

Optionally, the waveguide circulator described herein may comprise a dielectric sleeve surrounding at least partially the periphery of the ferrite element positioned within the recess. In some implementations, the presence of such a dielectric sleeve may facilitate the manipulation of the ferrite element during the manufacturing of the waveguide circulator, may have a beneficial effect on the susceptance slope parameter of the circulator and/or may increase the peak power handling of the waveguide circulator.

In an alternate non-limiting embodiment, the ferrite element is a first ferrite element, the recess within which the first ferrite element is positioned is a first recess positioned on the upper inner surface of the junction and the projection extending from the upper outer surface of the junction is a first projection. In this alternate embodiment, the circulator comprises a second ferrite element positioned within a second recess formed within the lower inner surface of the junction opposite the first recess, the second ferrite element including a first portion that projects into the junction and a second portion that extends into the second recess. The circulator also comprises a second projection extending from a lower outer surface of the junction opposite the lower inner surface of the junction, the projection being positioned opposite the second recess formed on the lower inner surface of the junction.

In accordance with another aspect, the invention relates to a method of manufacturing a waveguide circulator assembly, the method comprising manufacturing a first waveguide portion of a waveguide circulator assembly and manufacturing a second waveguide portion of a waveguide circulator assembly. The first waveguide portion has interior and exterior first waveguide portion surfaces. The interior first waveguide portion surface of the first waveguide portion defines upper surfaces of at least three waveguide arms intersecting at a junction and an upper inner surface of the junction. A recess for receiving therein a ferrite element is formed within the upper inner surface of the junction. The exterior first waveguide portion surface of the first waveguide portion defines an upper outer surface of the junction opposite the upper inner surface of the junction and a projection extending from the upper outer surface, the projection being positioned opposite the recess formed on the upper inner surface of the junction. The second waveguide portion of the waveguide circulator assembly has interior and exterior second waveguide portion surfaces. The interior second waveguide portion surface of the second waveguide portion of the waveguide circulator assembly defines lower surfaces of the at least three waveguide arms intersecting at the junction and a lower inner surface of the junction. The exterior second waveguide portion surface of the second waveguide portion of the waveguide circulator assembly defines a lower outer surface of the junction opposite the lower inner surface of the junction. The method also comprises positioning a ferrite element within the recess formed on the interior first waveguide portion surface and fastening the first waveguide portion to the second waveguide portion, such that, when connected, the interior first waveguide portion surface and the interior second waveguide portion surface together define a complete shape of the waveguide circulator.

In accordance with a specific implementation, a second recess for receiving therein a second ferrite element is also formed on the lower inner surface of the junction defined by the interior second waveguide portion surface. A projection extending from the lower outer surface is also defined by the exterior second waveguide portion surface, the projection being positioned opposite the recess formed on the lower inner surface of the junction.

In accordance with another aspect, the invention relates to a waveguide circulator comprising at least three waveguide arms intersecting at a junction, wherein the junction has an upper surface and a lower surface and wherein a recess for receiving therein a ferrite element is formed within one of the upper surface and the lower surface of the junction.

Some specific implementations of the waveguide circulators of the type presented may provide advantages over waveguide circulators using non-recessed ferrite elements such as, for example, a more simple design which can be more economical to manufacture and (or) a less bulky structure.

Other aspects and features of the present invention will become apparent to those ordinarily skilled in the art upon review of the following description of specific embodiments of the invention in conjunction with the accompanying drawings.

BRIEF DESCRIPTION OF THE DRAWINGS

A detailed description of specific embodiments of the present invention is provided herein below with reference to the accompanying drawings in which.

Figure 1A:
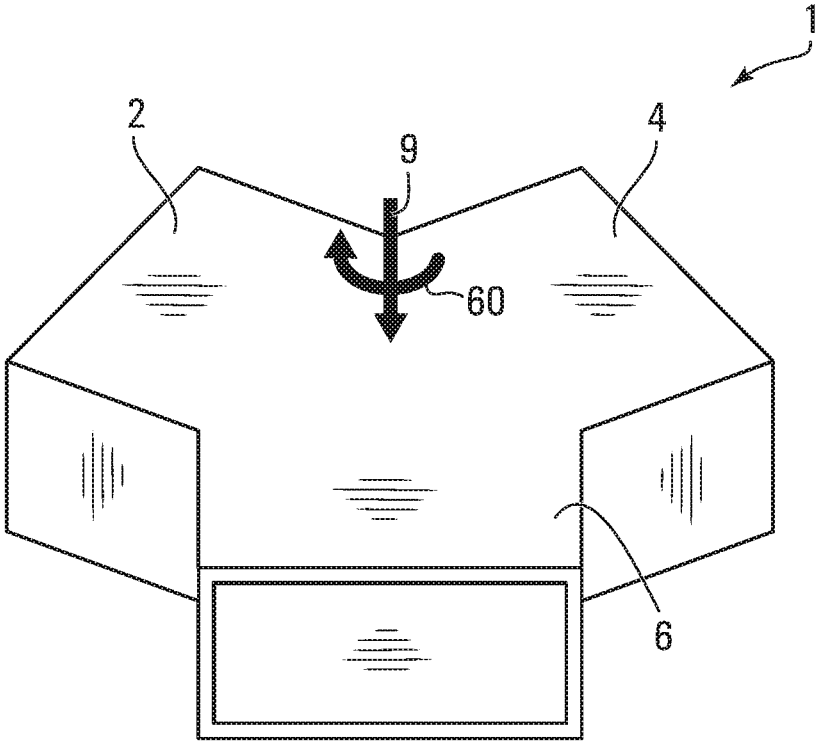
FIG. 1A (Prior Art)
FIG. 1A shows a perspective view of a waveguide circulator in accordance with a typical configuration.
Figure 1B:
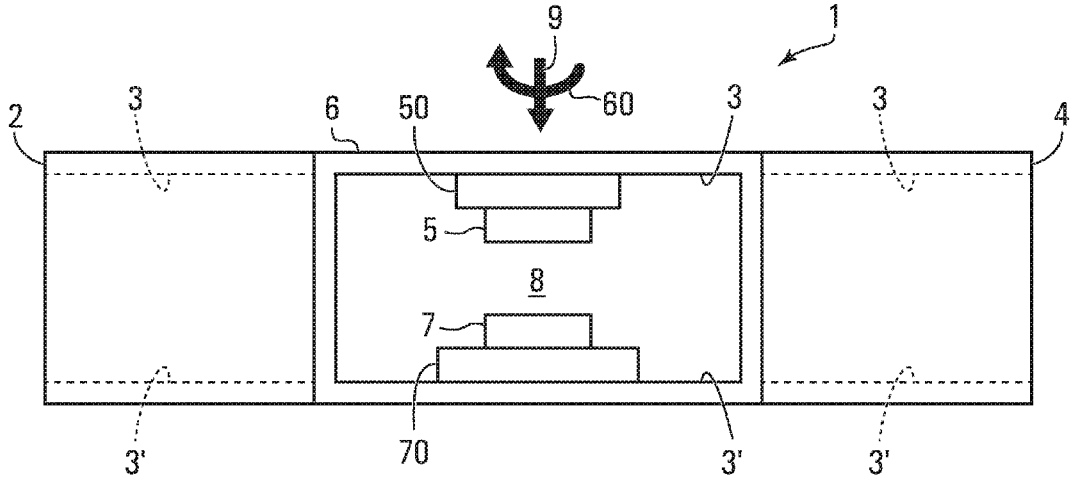
FIG. 1B (Prior Art)
FIG. 1B shows a side plan view of the waveguide circulator of FIG. 1A, exposing the interior of a waveguide arm.

In the drawings, embodiments of the invention are illustrated by way of example. It is to be expressly understood that the description and drawings are only for the purpose of illustrating certain embodiments of the invention and are an aid for understanding. They are not intended to be a definition of the limits of the invention.

DETAILED DESCRIPTION

A waveguide circulator configuration proposed in the present document includes one or more (gyromagnetic) ferrite elements positioned within one or more respective recesses formed within the junction of the waveguide circulator. The configuration proposed also includes one or more projections formed on the outer surface(s) opposite the recess(es) within which the ferrite element(s) is(are) positioned. In use, each of the ferrite elements may be magnetized by applying a magnetic field thereto using a magnet, the magnet being shaped for matingly engaging a projection formed on the outer surface of the waveguide circulator opposite a recess within which a ferrite element is positioned. Alternatively, each of the ferrite elements may be magnetized by using an electromagnet including a wire loop, wherein the wire loop is wound at least partially around a projection formed on the outer surface of the waveguide circulator opposite a recess within which a ferrite element is positioned.

Specific examples of waveguide circulators will now be described to illustrate the manner in which the principles of the invention may be put into practice. Such waveguide circulators may have particular utility in satellite communications equipment encompassing both ground and space segments, as well as in the radar and the medical fields.

Figure 2:
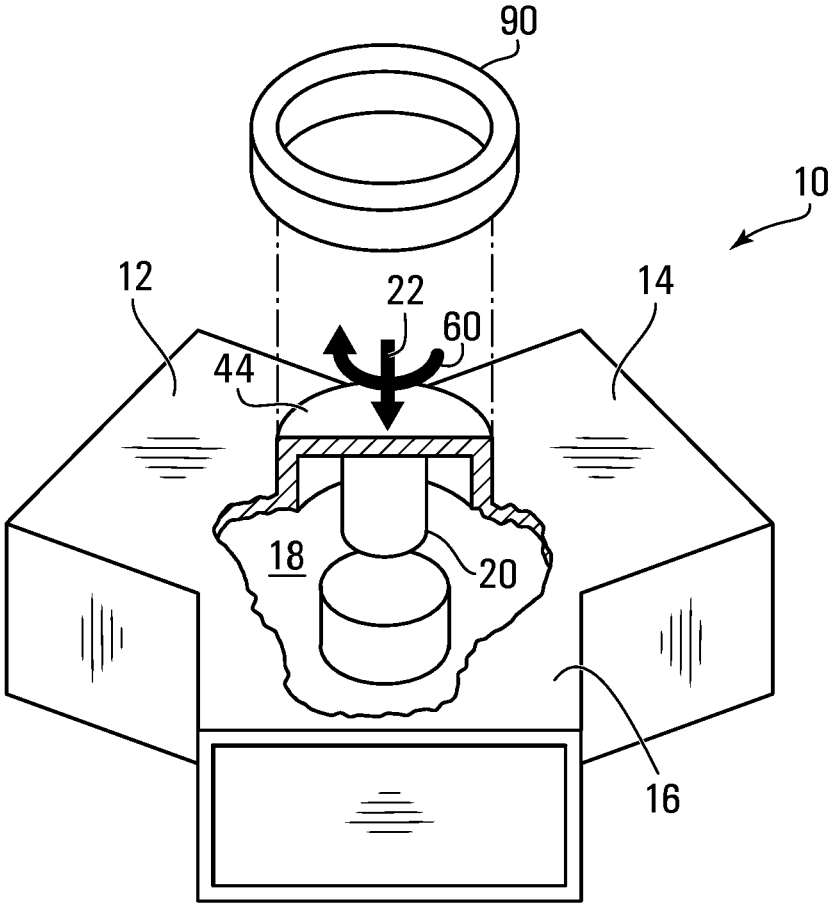
FIG. 2 shows a perspective view of a waveguide circulator in accordance with a first non-limiting example of implementation of the present invention with a portion broken away to show the interior components of the circulator, and a magnet shaped for engaging a projection on an outer-surface of the waveguide circulator.

A first non-limiting example of implementation of the present invention is shown in FIG. 2 of the drawings. Shown in FIG. 2 is a perspective view of a waveguide circulator 10 which comprises three waveguide arms 12, 14 and 16 that meet at a common junction 18. In the embodiment shown, the three waveguide arms 12, 14 and 16 are evenly spaced at 120° angles in relation to each other. Although three evenly spaced waveguide arms 12, 14 and 16 are shown in the Figures, alternative embodiments of the waveguide circulator may include more or fewer than three waveguide arms and (or) may include waveguide arms that are not evenly spaced in relation to one another.

Figure 3:
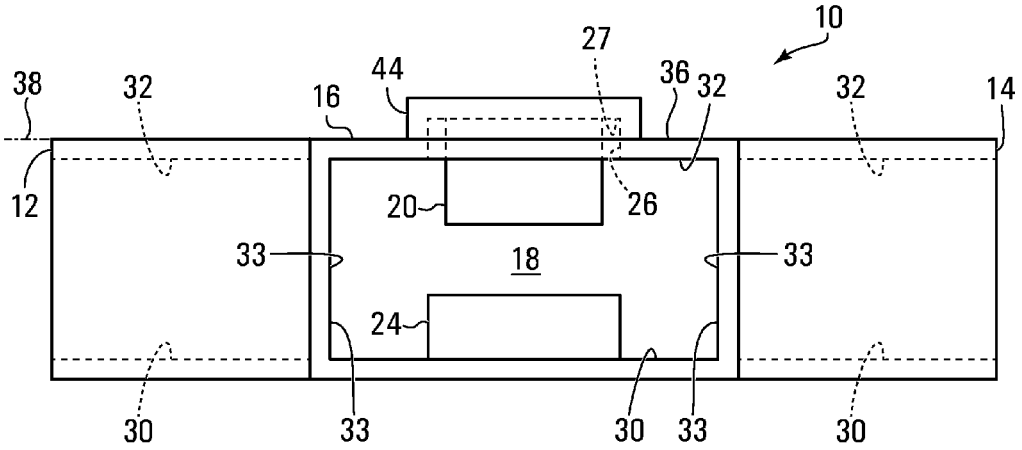
FIG. 3 shows a side plan view of the waveguide circulator of FIG. 2, exposing the interior of a waveguide arm.

Shown in FIG. 3 is a side view of the waveguide circulator 10 with a view into waveguide arm 16. The waveguide arm 16 has substantially rectangular cross section, defined by a lower inner surface 30, an upper inner surface 32 and two side inner surfaces 33. Waveguide arms 12 and 14 are similarly constructed. In a specific example of configuration, the rectangular waveguide arms 12, 14 and 16 have an aspect ratio in the order of 2:1 (a:b where "a" is the length of the larger sides and "b" is the length of the smaller sides of the waveguide), such that the waveguide arms can propagate wave energy in the transverse electric (TE10) mode. It will be appreciated by the person of skill that other aspect ratios may be used and determined in accordance with techniques known in the art. Such known techniques are beyond the scope of the present application and therefore will not be described in further detail here. Although the waveguide arms shown are of a generally rectangular cross section, it should also be appreciated that, in alternate implementations, the waveguide arms may have other cross sections, such as for example, oval, or circular cross-sections.

Positioned within the junction 18 of the waveguide circulator 10 is a gyromagnetic element 20, which is typically made of a ferrite material and which for the purpose of the present description will hereinafter be referred to as ferrite element 20.

The ferrite element 20 is positioned within a recess defined within the upper inner surface 32 of the junction 18. In specific practical implementations, the ferrite element 20 may be fastened onto a wall of the recess using any suitable adhesive or glue. It will be appreciated by the person skilled in the art that in other implementations, it is possible to have the ferrite element 20 alternatively positioned within a recess defined on the lower inner surface 30 of the junction 18 (not shown).

The shape of the recess defined within the upper inner surface 32 of the junction 18 is defined by peripheral inner wall 26 and top inner wall 27. It will be appreciated by the person skilled in the art that the peripheral inner wall 26 and top inner wall 27 may be manufactured as separate pieces one from another, as well as separate pieces from the upper inner surface 32. Alternative configurations are also possible, for example, the peripheral inner wall 26 and top inner wall 27 may be manufactured as a unitary piece which is a separate piece from the upper inner surface 32, or which is a unitary piece together with the upper inner surface 32.

Figure 4A:
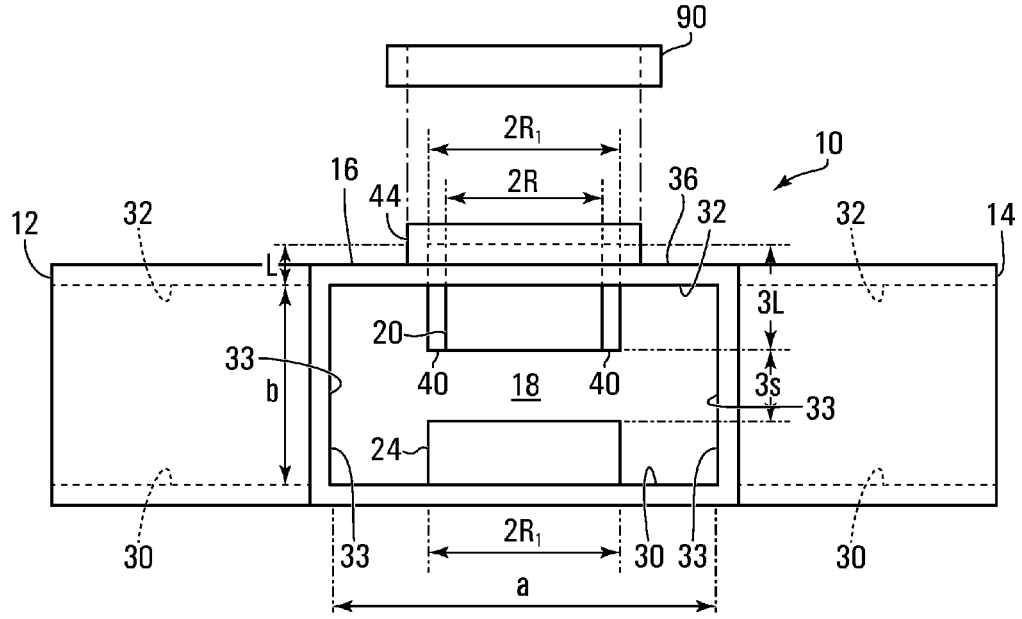
FIG. 4A shows a side plan view of a waveguide circulator of the type shown in FIGS. 2 and 3, exposing the interior of a waveguide arm, characterized by a first non-limiting set of relative dimensions for specific elements.
Figure 4B:
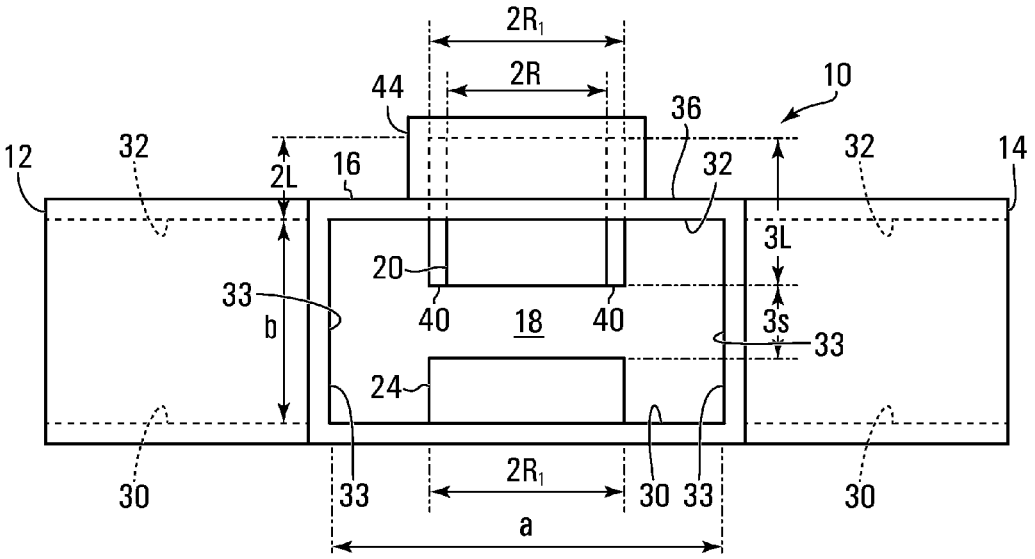
FIG. 4B shows a side plan view of a waveguide circulator of the type shown in FIGS. 2 and 3, exposing the interior of a waveguide arm, characterized by a second non-limiting set of relative dimensions for specific elements.

FIGS. 4A and 4B show side plan views of waveguide circulators of the type shown in FIGS. 2 and 3, characterized respectively by first and second non-limiting set of relative dimensions for specific elements.

FIG. 4A shows a specific configuration in which the ferrite element 20 is positioned within the recess defined within the upper inner surface 32 such that a first portion projects into the junction 18, and a second portion extends into the recess. The ferrite element 20 therefore has at least a part thereof that lies above an outer surface level 38 defined by the upper outer surface 36 of the junction 18, where the upper outer surface 36 is opposite the upper inner surface 32. For example, in the specific configuration shown in FIG. 4A, the ferrite element 20 has a total height of H=3L and a first portion thereof of height 2L that projects into the junction 18 and a second portion thereof of height L that extends into the recess defined within the upper inner surface 32 of the junction 18.

FIG. 4B shows a variant of the configuration shown in FIG. 4A, and includes recessed ferrite element 20 having a total height of H=3L whereby the difference lies in that the ferrite element 20 has a first portion thereof of height L that projects into the junction 18 and a second portion thereof of height 2L that extends into the recess defined within the upper inner surface 32 of the junction 18.

It will be appreciated by the person skilled in the art that in alternative configurations, the height of the first and second portions of the ferrite element 20 may vary from the above and may be determined based on the information presented here and (or) using basic experimentation. Generally speaking, for a total height of H for the ferrite element, we have x*H projecting in the waveguide, and (1−x)*H in the recessed region, where $0<x<1$.

In the specific configurations shown in FIGS. 4A and 4B, the ferrite element 20 may have a diameter that is generally smaller, than the diameter of the recess defined within the upper inner surface 32 such that the periphery of the ferrite element 20 is not in direct contact with peripheral inner wall 26 of the recess. In a specific practical implementation, as best shown in FIGS. 4A and 4B, the ferrite element 20 may have a diameter 2R and the recess defined within the upper inner surface 32 may have a diameter $2R_1$ where $2R<2R_1$. It will be appreciated by the person of skill that, in order to obtain a desired behavior and performance, the selection of the dimensions for R and R1 may be influenced, amongst other, by the operation frequency of the circulator and dimensions of other elements of the circulator. For example, the size of R may notably be influenced by the operation frequency of the circulator and the size of R1 may be influenced (or may itself influence) the dimension of the gap between the ferrite element and the opposing element 24 (or the filling factor). When designing a circulator suitable for a specific practical application, conventional approaches for calculating and experimenting with different R and R1 values may be used in order to select specific values. The specific approach used for determining the values of R and R1, or the ratio R/R1, is not critical to the present invention and as such will not be described further here.

An opposing element 24, which is also referred to as a "piston", is positioned on an inner lower surface 30 within the junction 18 such that it is positioned in a spaced-apart, opposing relationship, relative to the ferrite element 20. In specific implementations, the opposing element 24 is formed as a projection on the inner lower surface 30 of the junction 18 and is made of the same material as that surface 30. In the specific embodiment depicted here, the opposing element 24 has a circular shape however it is to be noted that in alternative implementations the opposing element may have other suitable shapes as well. The opposing element 24 depicted in the Figures is of a diameter which substantially corresponds to the diameter of the recess defined within the upper inner surface 32 of the junction 18. For example, in the configurations shown in FIGS. 4A and 4B, the ferrite element has a diameter of 2R and both the recess defined within the upper inner surface 32 of the junction 18 and the opposing element 24 have a diameter of $2R_1$ where $2R<2R_1$. It will be appreciated by the person skilled in the art that in alternative configurations, the diameter of the piston 24 may vary depending on the specific waveguide application required. Such variants may be determined based on the information presented here and (or) using basic experimentation.

The spaced-apart relationship of the opposing element 24 and the ferrite element 20 creates a space between the ferrite element 20 and the element 24, shown as 3s in FIGS. 4A and 4B. It will be appreciated by the person skilled in the art that the space between the ferrite element 20 and the element 24 may vary depending on the specific waveguide application required, for example on the desired "filling factor" of the waveguide, which in turn, has an effect on the gain bandwidth, and the peak power handling of the waveguide circulator. As such, the space between the ferrite element 20 and the element 24 may be determined using techniques known in the art and basic experimentation.

The circulator 10 further includes a projection 44 which extends from the upper outer surface 36 of the junction 18 such that the projection 44 is opposite the recess within which the ferrite element 20 is positioned. The shape of the projection 44 generally corresponds to that one of the recess within which the ferrite element 20 is positioned. For example, in the configurations shown, the recess has a generally cylindrical disk shape and the projection 44 has a complementary generally disk shape. In use, a magnet or electromagnet shaped to engage the projection 44 is used to magnetize the ferrite element 20 positioned within the recess.

In the first configuration shown in FIG. 2, the circulator includes a generally circular shape projection 44 for receiving a magnet 90 which is shaped as a ring such that the magnet 90 matingly engages the disk shaped projection 44. In use, the magnet 90 engaged onto the projection 44 produce a unidirectional magnetic field (represented by arrow 22 in FIG. 2).

Figure 5:
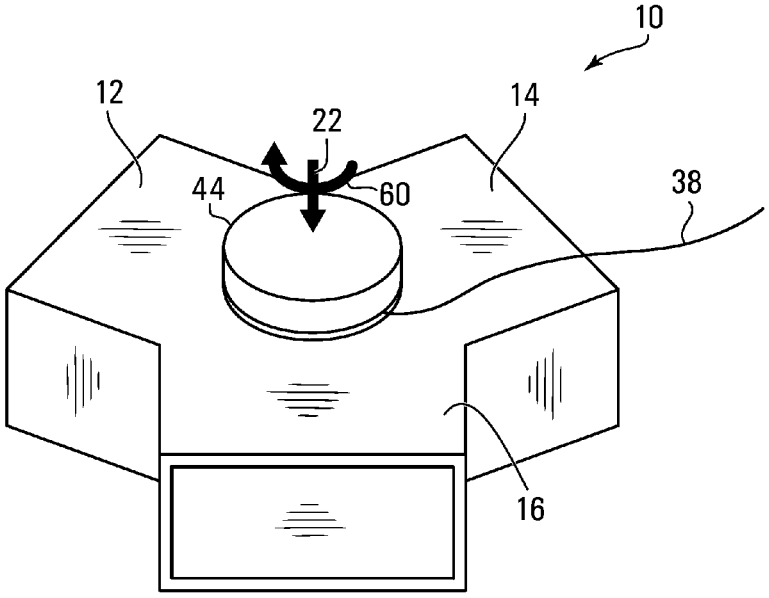
FIG. 5 shows a perspective view of a variant of the waveguide circulator of FIG. 2 on which an electromagnet including a wire loop has been positioned.

In a variant of the configuration shown in FIG. 2, shown in FIG. 5, the circulator includes a generally disk shaped projection 44 for receiving an electromagnet which includes a wire loop 38, where the wire loop 38 is wounded at least partially around the projection 44. In use, an electrical current is passed through the wire loop 38 wound at least partially around the projection 44 to produce a unidirectional magnetic field (represented by arrow 22 in FIG. 4).

As best shown in FIGS. 2 and 5, the magnetic field 22 that is generated is a unidirectional magnetic field, such that wave energy entering each waveguide arm 12, 14 and 16 will move in a clockwise direction (represented by arrow 60) towards the neighboring waveguide arm. For example, wave energy from waveguide arm 12 propagates to waveguide arm 14. Likewise, wave energy from waveguide arm 14 propagates to waveguide arm 16 and wave energy entering waveguide arm 16 propagates to waveguide arm 12. In this manner, wave energy is always propagated in a single direction. As such, the waveguide circulator 10 is a non-reciprocal transmitter of electromagnetic wave energy propagating in the waveguide arms. By changing the direction of the magnetic field, for example by changing the direction of the current passed through wire loop 38, it is possible for the wave energy to propagate in the opposite, counter-clockwise, direction. However, regardless of the direction in which the wave energy is propagated, it can only ever travel in one direction at a time.

The person of skill will appreciate that by controlling the direction of the magnetic field, it is therefore possible to control the direction of propagation of the wave energy. For example, in the case of an electromagnet including a wire loop 38, the direction of the magnetic field can be changed simply by changing the direction of the current applied to the wire loop 38. As a result of such a configuration, the waveguide circulator 10 can be configured to act as a switch.

Advantageously, a waveguide circulator 10 designed accordingly may simplify the manufacturing process thereof, for example, the magnet or electromagnet can be positioned onto the projection 44 once the circulator is assembled.

A second non-limiting example of implementation of the present invention is shown in FIG. 5 of the drawings. Shown in FIG. 5 is a perspective view of a waveguide circulator 100 which comprises similar features as those of the circulator 10. Therefore, for the purpose of conciseness, primarily the differences are described. Features on the waveguide circulator 100 that are similar to features on the waveguide circulator 10 are assigned corresponding reference numbers.

Figure 7:
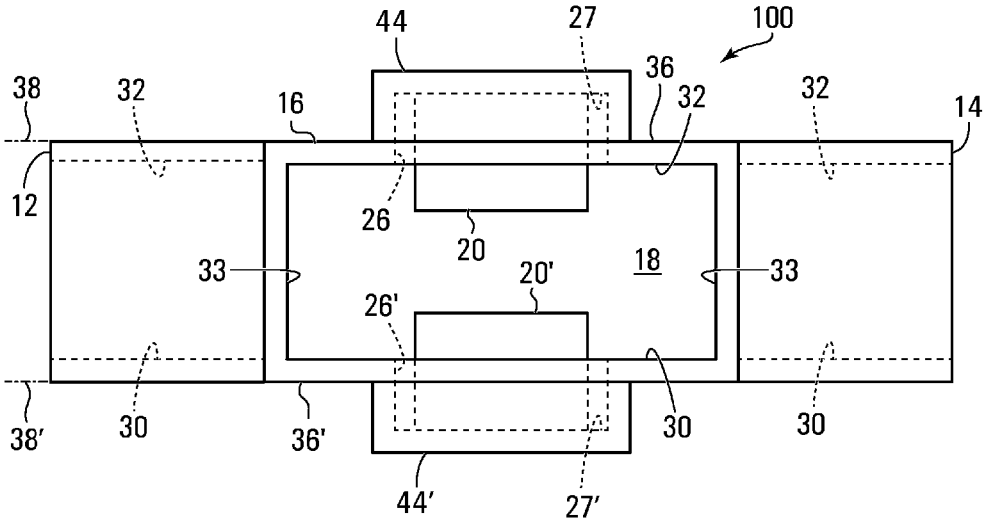
FIG. 7 shows a side plan view of the waveguide circulator of FIG. 6, exposing the interior of a waveguide arm.

Shown in FIG. 7 is a side view of the waveguide circulator 100 with a view into waveguide arm 16. Positioned within the junction 18 of the waveguide circulator 100 is a first ferrite element 20 and a second ferrite element 20'. The first ferrite element 20 is positioned within a first recess defined within the upper inner surface 32 of the junction 18, and the second ferrite element 20' is positioned within a second recess defined within the lower inner surface 30 of the junction 18. In specific implementations, the first and second ferrite elements 20 and 20' may be fastened onto the walls of the respective recess within which each is positioned using any suitable adhesive or glue.

The shape of the first recess defined within the upper inner surface 32 of the junction 18 is defined by peripheral inner wall 26 and top inner wall 27. The shape of the second recess defined within the lower inner surface 30 of the junction 18 is defined by peripheral inner wall 26' and bottom inner wall 27'.

Figure 6:
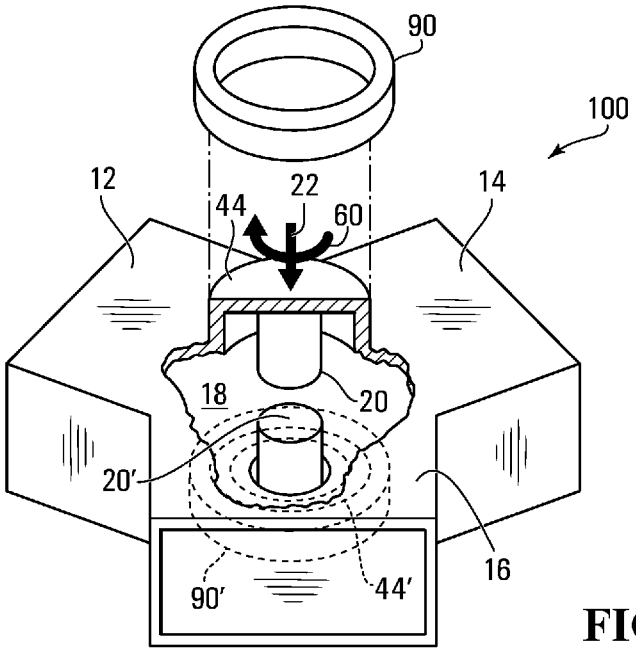
FIG. 6 shows a perspective view of a waveguide circulator in accordance with a second non-limiting example of implementation of the present invention with a portion broken away to show the interior components of the circulator, and two magnets shaped for engaging respective projections on outer-surfaces of the waveguide circulator.
Figure 8A:
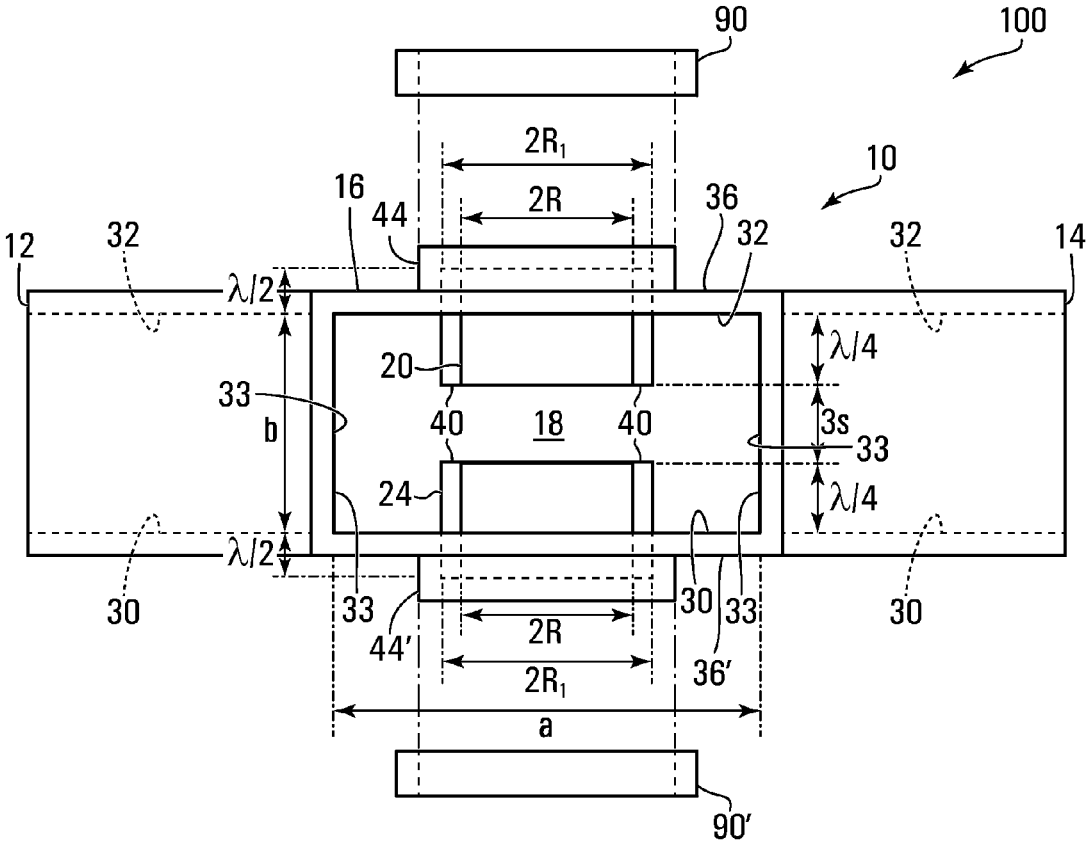
FIG. 8A shows a side plan view of a waveguide circulator of the type shown in FIGS. 6 and 7, exposing the interior of a waveguide arm, characterized by a first non-limiting set of relative dimensions for specific elements.
Figure 8B:
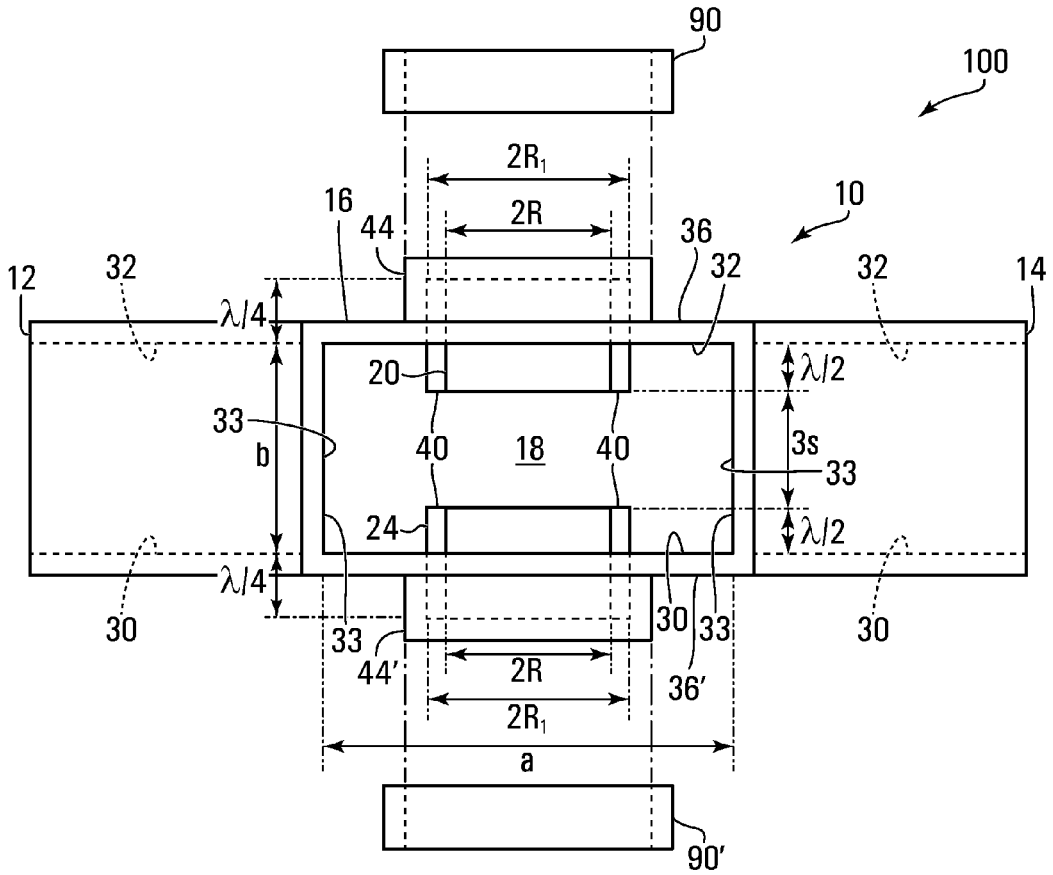
FIG. 8B shows a side plan view of a waveguide circulator of the type shown in FIGS. 6 and 7, exposing the interior of a waveguide arm, characterized by a second non-limiting set of relative dimensions for specific elements

FIGS. 8A and 8B show side plan views of waveguide circulators of the type shown in FIGS. 6 and 7, characterized respectively by first and second non-limiting set of relative dimensions for specific elements.

FIG. 8A shows a specific configuration in which the first ferrite element 20 is positioned within the first recess defined within the upper inner surface 32 such that a first portion thereof projects into the junction 18, and a second portion thereof extends into the recess defined within the upper inner surface 32. The first ferrite element 20 therefore has at least a part thereof that lies above an outer surface level 38 defined by an upper outer surface 36 of the junction 18, where the upper outer surface 36 is opposite the upper inner surface 32. The second ferrite element 20' is positioned within the second recess defined within the lower inner surface 30 such that a first portion thereof projects into the junction 18, and a second portion thereof extends into the second recess defined within the lower inner surface 30. The second ferrite element 20' therefore has at least a part thereof that lies below an outer surface level 38' defined by a lower outer surface 36' of the junction 18, where the lower outer surface 36' is opposite the lower inner surface 30. In the specific configuration shown in FIG. 8A, each of the first and second ferrite elements 20 and 20' has a total height of $H=\frac{3}{4}\lambda$, where $\lambda$ is the wavelength corresponding to the operating frequency of the circulator 100. Each of the first and second ferrite elements 20 and 20' have a first portion thereof of height $\lambda/4$ that projects into the junction 18 and a second portion thereof of height $\lambda/2$ that extends into their respective first and second recesses. It is noted that in alternative implementations, the size of the ferrite may be of any suitable height H, wherein x*H projects in the waveguide, and (1−x)*H in the recessed region, where $0<x<1$.

FIG. 8B shows a variant of the configuration shown in FIG. 8A, and includes recessed first and second ferrite elements 20 and 20' each having a total height of $H=\frac{3}{4}\lambda$ whereby the difference lies in that each of the first and second ferrite elements 20 and 20' have a first portion thereof of relative height $\lambda/2$ that projects into the junction 18 and a second portion thereof of relative height $\lambda/4$ that extends into their respective first and second recesses.

It will be appreciated by the person skilled in the art that in alternative configurations, the relative height of the first and second portions of the first and second ferrite elements 20 and 20' may vary, together or independently one from another, and may be determined based on the information presented here and (or) using basic experimentation.

In the specific configurations shown in FIGS. 8A and 8B, the first and second ferrite elements 20 and 20' each may have a diameter that is generally smaller than the diameter of the respective first and second recess within which each is positioned such that the periphery of the first and second ferrite elements 20 and 20' is not in direct contact with respective peripheral inner walls 26 and 26'. For example, as best shown in FIGS. 8A and 8B, each of the first and second ferrite elements 20 and 20' have a diameter 2R and the respective first and second recesses have a diameter $2R_1$ where $2R<2R_1$. In a manner similar as that described above with reference to the embodiment depicted in FIGS. 4A and 4B, it will be appreciated by the person of skill that, in order to obtain a desired behavior and performance, the selection of the dimensions for R and R1 may be influenced, amongst other, by the operation frequency of the circulator and dimensions of other elements of the circulator. For example, the size of R may notably be influenced by the operation frequency of the circulator and the size of R1 may be influenced (or may itself influence) the dimension of the gap between the ferrite element and the opposing element 24 (or the filling factor). When designing a circulator suitable for a specific practical application, conventional approaches for calculating and experimenting with different R and R1 values may be used in order to select specific values. The specific approach used for determining the values of R and R1, or the ratio R/R1, is not critical to the present invention and as such will not be described further here.

The circulator 100 further includes a first projection 44 which extends from the upper outer surface 36 of the junction 18 such that the projection 44 is opposite the first recess within which the first ferrite element 20 is positioned. The circulator 100 further includes a second projection 44' which extends from the lower outer surface 36' of the junction 18 such that the projection 44' is opposite the second recess within which the second ferrite element 20' is positioned. The shape of the first and second projections 44 and 44' generally corresponds to the shape of the respective recesses within which are positioned the first and second ferrite elements 20 and 20'. For example, in the configurations shown, the first and second recesses within which are positioned the ferrite elements 20 and 20' each have a generally cylindrical disk shape and the first and second projections 44 and 44' each have a respective complementary generally circular shape. In use, a magnet or electromagnet shaped to engage respective first and second projections 44 and 44' are used to magnetize the first and second ferrite elements 20 and 20' positioned within their respective first and second recesses.

In the first configuration shown in FIG. 6, the circulator 100 includes circular projection 44 and 44' having a generally circular shape for receiving first and second magnets 90 and 90' where each magnet is shaped as a ring for matingly engaging with the respective first and second disk shaped projections 44 and 44'. In use, the magnets 90 and 90' engaged onto the respective first and second projections 44 produce a unidirectional magnetic field (represented by arrow 22 in FIG. 6).

Figure 9:
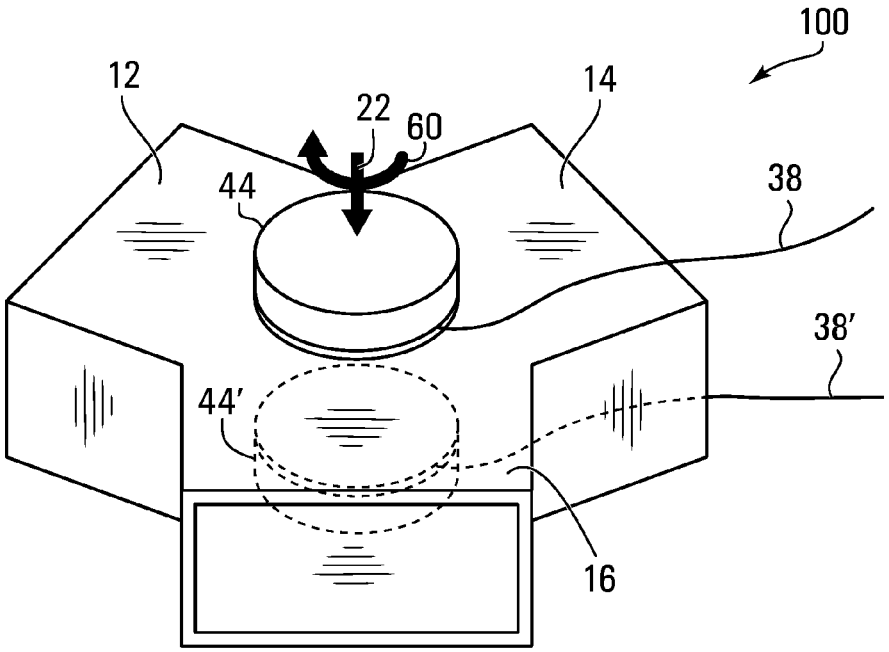
FIG. 9 shows a perspective view of a variant of the waveguide circulator of FIG. 6 on which two electromagnets each including a wire loop have been positioned.

In a variant of the configuration shown in FIG. 6, shown in FIG. 9, the circulator 100 includes first and second circular projection 44 and 44' having a generally circular shape for receiving first and second electromagnets which each include respective first and second wire loops 38 and 38', where the first and second wire loops 38 and 38' are wounded at least partially around the respective first and second projections 44 and 44'. In use, an electrical current passes through the wire loops 38 and 38' of the first and second electromagnets engaged onto the respective first and second projections 44 to produce a unidirectional magnetic field (represented by arrow 22 in FIG. 9).

Use of the magnetic field with or without the added switch functionality of the circulator has been described previously and for conciseness, will not be repeated here.

While the circulator depicted in FIGS. 2, 3, 6 and 7 illustrate embodiments of the invention for circulators displaying degree-1 responses (1-pole), the concepts presented in the present document may also be applied to circulators displaying a degree-2 response (2-pole). In particular, conventional degree-2 circulators require transformers to be formed on the inner junction walls around the ferrite elements to match the impedance of the waveguide to that of the ferrite elements. The presence of such transformers may contribute to increase the thickness of such conventional circulator. By positioning the one or more ferrite elements within one or more respective recesses formed within the junction of the waveguide circulator, the transformer(s) can be embedded within the recess itself, for example with use of a dielectric transformer in the recessed region, before the ferrite. This may contribute in reducing the size of the resulting circulator.

More particularly, in some embodiments, the circulator may include a dielectric sleeve which surrounds at least partially the periphery of the ferrite element(s) such as to at least partially fill the gap between the peripheral surface of the ferrite element(s) and the recess(es), where the gap corresponds to $2R_1-2R$. Such dielectric sleeve is shown as dielectric sleeve 40 in FIGS. 4A, 4B, 8A and 8B. For example, a circulator configured according to FIG. 4A having a ferrite element 20 having a total dimension H=3L=¾-wave length (¾λ) may make use of a dielectric sleeve 40 having a dielectric constant $\in_d$ selected within the range of about 1 to about 15. It will be appreciated by the person of skill that the dielectric sleeve dielectric constant $\in_d$ may vary depending on the desired application and may be determined using basic experimentation.

In the above description, only three ports (waveguide arms 12, 14 and 16) have been shown and discussed. It should however be appreciated that the recessed ferrite element configurations shown and described herein could be equally applied to T-junction circulators, four-port circulators, or circulators having any number of ports.

The ferrite element(s) depicted in the Figures are of a generally cylindrical disk shape and the recesses within which the ferrite elements are positioned are of a complementary (hollow) cylindrical shape as well. It will be appreciated by the person skilled in the art that in alternative configurations, the ferrite elements may be of any suitable shape such as, but not limited to triangular shape, hexagonal shape and/or any suitable polygonal shape. In such alternate configurations, the recesses within which the ferrite elements would be positioned as well as corresponding projection may also be of a corresponding complementary shape. Alternatively still, the recesses and the ferrite elements may have different shapes; one example could be a cylindrical ferrite element in a hexagonal recess, or a cylindrical recess in which is positioned a hexagonal ferrite element, etc. In such implementations, a dielectric sleeve may surround at least partially the periphery of the ferrite element and may have an outer periphery that complements the shape of the recess and an inner periphery that complements the periphery of the ferrite element such as to at least partially fill the gap between the peripheral surface of the ferrite element and the recess. In practical implementations, the ferrite element(s) can be formed as a unitary solid piece or, alternatively, may be formed by multiple pieces stacked to form a disk shape, triangular shape, hexagonal shape or general polygonal shape. Similarly, the recess(es) as well as projection(s) can be formed as a unitary solid piece or, alternatively, may be formed by multiple pieces stacked to form a disk shape, triangular shape, hexagonal shape or general polygonal shape.

The ferrite element(s) will typically be made of ferrite materials known in the art of waveguides having suitable magnetic properties, such as for example, materials including iron oxide with impurities of other oxides, lithium ferrite materials, magnesium manganese ferrite materials, nickel ferrite materials, and the like.

Waveguide circulators of the type described herein can be manufactured via molding, casting, or machining, among other possible manufacturing techniques.

In accordance with a non-limiting example of implementation, waveguide circulators of the type described herein may be made of aluminum. However, it should be appreciated that waveguide circulators of the type described herein could alternatively be made of any suitable material, such as copper, brass, or, more generally and among other possibilities, any material that could be suitably plated with silver or copper.

Figure 10:
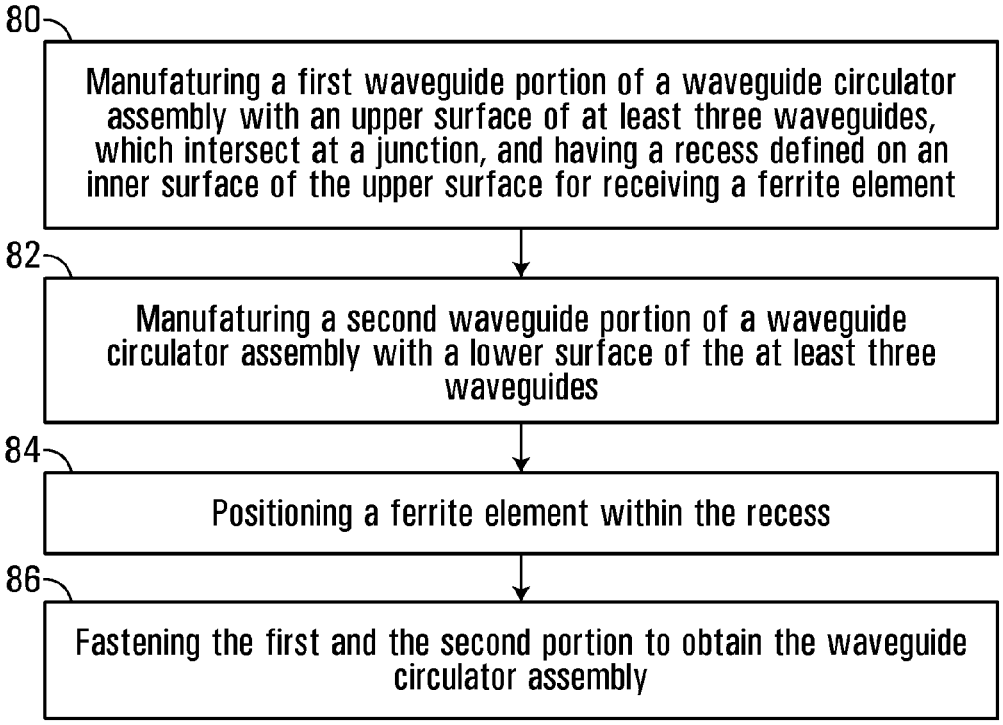
FIG. 10 shows a non-limiting flow diagram of a process for manufacturing a waveguide circulator in accordance with the present invention.

FIG. 10 of the drawings depicts an illustrative non-limiting process for manufacturing a waveguide circulator of the type described in the present application. More specifically and as shown, the process includes a step 80 of manufacturing a first waveguide portion of a waveguide circulator assembly and a step 82 of manufacturing a second waveguide portion of a waveguide circulator assembly. More particularly, step 80 comprises manufacturing a first waveguide portion of a waveguide circulator assembly comprising an upper surface of at least three waveguides, which intersect at a junction, a recess defined on an inner surface of the upper surface for receiving a ferrite element, and a projection extending from an outer surface of the upper surface, where the projection is opposite the recess defined in the inner surface of the upper surface. Step 82 comprises manufacturing a second waveguide portion of a waveguide circulator assembly comprising a lower surface of the at least three waveguides, which intersect at a junction. Optionally, a recess for receiving therein a ferrite element is also formed on the lower inner surface of the junction defined by the interior second waveguide portion surface and a projection extending from the lower outer surface is also defined by the exterior second waveguide portion surface, the projection being positioned opposite the recess formed on the lower inner surface of the junction.

The process further includes a step 84 which comprises positioning a ferrite element within the recess formed on the interior first waveguide portion surface. Following step 82, an optional step (not shown) may be present when the second waveguide portion includes the optional second recess for receiving the second ferrite element, and comprises positioning a second ferrite element within the second recess formed on the interior second waveguide portion surface. Optionally, a dielectric sleeve may be positioned on the ferrite element(s) prior to, or after, positioning the ferrite element(s) within the recess(es).

The process further includes a step 86, which comprises fastening the first waveguide portion to the second waveguide portion, such that, when connected, the interior first waveguide portion surface and the interior second waveguide portion surface together define a complete shape of the waveguide circulator.

Optionally, the process further includes positioning one or more magnet(s) shaped for matingly engaging the respective projection(s) extending from the outer surface of the upper (and (or) lower) surface(s) of the waveguide portions, or positioning one or more electromagnet(s) for example, of the type including a wire loop, onto the projection, such that, the corresponding one or more wire loop(s) are wound at least partially around the respective projection(s) extending from the upper (and (or) lower) surface.

The foregoing is considered as illustrative only of the principles of the invention. Since numerous modifications and changes will become readily apparent to those skilled in the art in light of the present description, it is not desired to limit the invention to the exact examples and embodiments shown and described, and accordingly, suitable modifications and equivalents may be resorted to. It will be understood by those of skill in the art that throughout the present specification, the term "a" used before a term encompasses embodiments containing one or more to what the term refers. It will also be understood by those of skill in the art that throughout the present specification, the term "comprising", which is synonymous with "including," "containing," or "characterized by," is inclusive or open-ended and does not exclude additional, un-recited elements or method steps.

Unless otherwise defined, all technical and scientific terms used herein have the same meaning as commonly understood by one of ordinary skill in the art to which this invention pertains. In the case of conflict, the present document, including definitions will control.

Although the present invention has been described in considerable detail with reference to certain embodiments thereof, variations and refinements are possible and will become apparent to persons skilled in the art in light of the present description. The invention is defined more particularly by the attached claims.

What is claimed is:

1. A waveguide circulator comprising:

a) at least three waveguide arms intersecting at a junction, wherein the junction has an upper inner surface and a lower inner surface;

b) a ferrite element positioned within a recess formed within one of the upper inner surface and the lower inner surface of the junction, the ferrite element including a first portion that projects into the junction and a second portion that extends into the recess;

c) a projection extending from one of the upper outer surface and the lower outer surface of the junction, the projection being positioned opposite the recess formed within the one of the upper inner surface and the lower inner surface of the junction, wherein the projection has a generally circular shape; and d) a ring magnet engaged with the projection for magnetizing the ferrite element positioned within the recess, wherein an inner periphery of the ring magnet is shaped to engage the projection.

2. The waveguide circulator according to claim 1, further comprising a dielectric sleeve surrounding at least partially said ferrite element.

3. The waveguide circulator according to claim 1, wherein an opposing element is positioned on the other one of the upper inner surface and the lower inner surface of the junction in a spaced-apart opposing relationship with said ferrite element.

4. The waveguide circulator according to claim 1, wherein:

a) the recess is within the upper inner surface of the junction; and b) the projection extends from the upper outer surface of the junction opposite the upper inner surface of the junction, the projection being positioned opposite the recess formed on the upper inner surface of the junction.

5. The waveguide circulator according to claim 4, wherein the upper outer surface of the junction defines an outer surface level and wherein the second portion of the ferrite element extends into the recess so that at least a part of the ferrite element lies above the outer surface level defined by the upper outer surface of the junction.

6. The waveguide circulator according to claim 1, wherein said ferrite element is a first ferrite element and wherein the recess within which the first ferrite element is positioned is a first recess formed within the upper inner surface of the junction, said circulator comprising a second ferrite element positioned within a second recess formed within the lower inner surface of the junction opposite said first recess, the second ferrite element including a first portion that projects into the junction and a second portion that extends into the second recess.

7. The waveguide circulator according to claim 6, wherein the projection is a first projection extending from the upper outer surface of the junction and wherein the circulator comprises a second projection extending from a lower outer surface of the junction opposite the lower inner surface of the junction, the projection being positioned opposite the recess formed on the lower inner surface of the junction.

8. A waveguide circulator comprising at least three waveguide arms intersecting at a junction, wherein the junction has an upper surface and a lower surface, wherein a recess for receiving therein a ferrite element is formed within one of the upper surface and the lower surface of the junction and wherein a projection extends from one of the upper outer surface and the lower outer surface of the junction, the projection being positioned opposite the recess formed on the upper inner surface or the lower inner surface of the junction, and the projection being shaped to engage a ring magnet for magnetizing the ferrite element received within the recess.

9. A method of manufacturing a waveguide circulator assembly, said method comprising:

a) manufacturing a first waveguide portion of a waveguide circulator assembly, the first waveguide portion having interior and exterior first waveguide portion surfaces, wherein:

i) the interior first waveguide portion surface defines:

(1) an upper inner surface of a junction wherein a recess for receiving therein a ferrite element is formed; and (2) upper surfaces of at least three waveguide arms intersecting at the junction;

ii) the exterior first waveguide portion surface defining:

(a) an upper outer surface of the junction opposite the upper inner surface of the junction;

(b) a projection extending from the upper outer surface, the projection being positioned opposite the recess formed on the upper inner surface of the junction, wherein the projection has a generally circular shape;

b) manufacturing a second waveguide portion of a waveguide circulator assembly, the second waveguide portion having interior and exterior second waveguide portion surfaces, wherein:

i) the interior second waveguide portion surface defines:

(1) a lower inner surface of the junction;

(2) lower surfaces of the at least three waveguide arms intersecting at the junction;

ii) the exterior second waveguide portion surface defines a lower outer surface of the junction opposite the lower inner surface of the junction;

c) positioning a ferrite element within the recess formed on the interior first waveguide portion surface;

d) positioning a ring magnet in engagement with the projection, the ring magnet being for magnetizing the ferrite element positioned within the recess, wherein an inner periphery of the ring magnet is shaped to engage the projection;

e) fastening the first waveguide portion to the second waveguide portion, such that, when connected, the interior first waveguide portion surface and the interior second waveguide portion surface together define a complete shape of the waveguide circulator.

10. A method as defined in claim 9, wherein a second recess for receiving therein a second ferrite element is formed on the lower inner surface of the junction defined by the interior second waveguide portion surface and wherein a second projection extending from the lower outer surface is defined by the exterior second waveguide portion surface, the second projection being positioned opposite the second recess formed on the lower inner surface of the junction.

* * * * *